United States Patent [19]

Yamaguchi

[11] 4,370,066

[45] Jan. 25, 1983

[54] CORRECTION SIGNAL INPUT SYSTEM FOR ELECTRONIC TIMEPIECE

[75] Inventor: Sizuo Yamaguchi, Tokorozawa, Japan

[73] Assignee: Citizen Watch Company Limited, Tokyo, Japan

[21] Appl. No.: 201,848

[22] Filed: Oct. 29, 1980

[30] Foreign Application Priority Data

Nov. 9, 1979 [JP] Japan ..... 54-145088

[51] Int. Cl.[3] ..... G04C 9/00

[52] U.S. Cl. ..... 368/188; 368/190

[58] Field of Search ..... 368/10, 69, 70, 190, 368/185, 186, 187, 188, 189, 251; 364/705, 706, 707

[56] References Cited

U.S. PATENT DOCUMENTS 4,282,513 8/1981 Meisner et al. ..... 368/185

*Primary Examiner*—J. V. Truhe

*Assistant Examiner*—Forester W. Isen

*Attorney, Agent, or Firm*—Jordan and Hamburg

[57] ABSTRACT

In an electronic timepiece having a central processing unit for processing current time and other data, and equipped with a crown and switch means coupled thereto for providing a correction signal comprising a pulse train of relatively high frequency, a bidirectional counter is provided for counting the correction signal pulses, with successive count totals in said counter being transferred in parallel form to be processed by the central processing unit. Processing of the high frequency correction pulses can thereby be performed even with the low maximum frequency which is generally available in an electronic timepiece for use as the clock signal to operate the central processing unit.

2 Claims, 5 Drawing Figures

CORRECTION SIGNAL INPUT SYSTEM FOR ELECTRONIC TIMEPIECE

BACKGROUND OF THE INVENTION

Before the advent of electronic timepieces, the most generally used method of correcting the time information of a wristwatch or other small timepiece was that of rotation of a crown. This method is therefore very familiar to many users, and has various other advantages. Various types of electronic timepieces have also been proposed in recent years, in which correction of current time, and in some cases also of the alarm time, is performed by rotation of a crown which is linked to a switch mechanism. Rotation of the crown causes the switch mechanism to generate a train of correction pulses, which are applied to the timekeeping counter circuits to correct the contents thereof, or to set in a desired alarm time. The rate at which these correction pulses are generated is determined by the rate at which the user rotates the crown, and various circuits have been devised whereby a large number of correction pulses can be generated for each rotation of the crown, so that the user can rapidly and conveniently perform time correction. In recent years, also, electronic timepieces have been designed in which a central processing unit (generally abbreviated to CPU) is utilized to perform various functions in the timepiece, including the timekeeping computations, etc. Use of a CPU provides a number of advantages, from a manufacturing viewpoint. Since the operation of the CPU, and hence the overall operation of the timepiece, is controlled by the CPU operating program, changes in the timepiece operation can be easily performed by changes in that operating program. Such changes are facilitated by the fact that the operating program of the CPU is generally stored in a read-only memory (generally abbreviated to ROM) integrated circuit, so that the operating program can be changed by modifying the contents of the ROM, by such methods as the memory mask technique. Thus, for the above reasons, it is possible to manufacture a wide range of timepieces having different functions and modes of operation, incorporating a single CPU integrated circuit of standardized design in each timepiece, with the operating program suitably modified for the particular type of timepiece. With conventional methods of electronic timepiece manufacture, in which randomly arranged logic is designed individually for each particular type of electronic timepiece integrated circuit, any change in the functions of a timepiece generally necessitates a complete redesign of the integrated circuit. Use of a CPU, therefore, enables design changes in electronic timepiece manufacture to be performed in a much more flexible and economical manner than is possible with previous methods of circuit implementation. However, the use of a CPU in an electronic timepiece equipped with a crown, for input of correction signal pulses, has hitherto involved various difficulties. These are basically due to the fact that the correction signal pulses from the switch mechanism coupled to the timepiece crown are generated as a serial pulse train, at relatively high frequency, whereas the CPU is limited in its capability for processing such high speed serial data. This is because the operating clock signal of the CPU, i.e. the basic timing clock of the CPU operation, is usually derived from the output of the quartz crystal oscillator which serves as the standard frequency signal source of the timepiece, and the CPU clock signal is therefore generally at half the frequency of the crystal oscillator output signal. Thus, since the quartz crystal oscillator circuit of the timepiece generally operates at a frequency of the order of 32 kHz, the maximum clock signal frequency available for operating the CPU is of the order of 16 kHz, i.e. the clock signal period is about 60 microseconds. It is a feature of a CPU circuit that its power consumption, when actually in operation, is extremely high, by comparison with the normal levels of power consumption of electronic timepiece circuitry. It is therefore usual to arrange that the CPU is normally held in a non-operative condition until some data processing operation is actually required, for example when time data updating is to be performed, or when input of a correction signal occurs. In the latter case, it is necessary for the CPU to first recognize the fact that some switch actuation has occurred, thereby generating the correction signal, before actual processing of the correction signal can begin. This recognition processing can take several hundreds of microseconds, due to the low clock signal frequency of the CPU operation. Thereafter, the correction signal data must be processed. Thus, in the case of a high speed input of correction pulses produced by a switch mechanism actuated by rotation of a crown, the CPU may simply be too slow in operation to process the input signal.

In order to successfuly utilize a CPU in an electronic timepiece equipped with a crown actuated switch for generating a high frequency train of correction pulses, therefore, it is necessary to provide some means of overcoming the basic mismatch between the correction pulse signal input and the relatively slow, essentially parallel, operation of the CPU. It should be noted that the rate of input of correction pulses from a crown-operated switch mechanism is completely random with respect to time, so that if the correction signal input is applied directly to the CPU, the latter must judge each switch closure representing a correction pulse individually, before processing that pulse, i.e. before adding to or subtracting a quantity corresponding to that correction pulse from previously stored data.

With the present invention, the above disadvantages of combining a CPU with a crown-operated correction switch mechanism in an electronic timepiece are eliminated, by providing a counter as a type of temporary storage means, or buffer, between the correction signal source and the CPU input. The contents of this counter are monitored by a zero detection circuit, which activates the CPU to begin processing of input data from the crown switch only after actuation of the crown has begun, the data contents of the input counter circuit being then transferred, in parallel form, to the CPU. This process is repetitively performed while the crown is being rotated. In this way, the rate at which data is generated by the crown-actuated correction switch need not be limited by the operating speed of the CPU.

SUMMARY OF THE INVENTION

The present invention comprises a correction data input system for an electronic timepiece which is equipped with switch means for generating a correction signal in response to rotation of a crown provided externally on the timepiece, and which is further equipped with a central processing unit (CPU) for the purpose of processing various types of data including that represented by said correction signal. The input system comprises a reversible counter (sometimes referred to as an UP/DOWN counter) which is coupled to receive the correction signal pulses, and to count up or count down in accordance with the direction of rotation of the crown. The CPU is normally in a non-operative condition, i.e. with the supply of clock pulses for its operation being cut off, and is only activated when a data processing operation is to be performed. In the case of data input from the crown-actuated correction switch comprising a train of correction signal pulses produced in response to rotation of the crown, a zero detection circuit coupled to the reversible counter detects when the count therein reaches some value other than zero, as a result of counting up (or counting down) the pulses of the correction pulse train. An output signal from the zero detection circuit is thereby produced, and applied to the CPU to initiate activation of the CPU operation. After this activation of the CPU, a control signal is sent out by the CPU, which causes the contents of the reversible counter circuit at that instant to be transferred, through a transfer gate in parallel form, to the CPU, to be processed thereby. Immediately after this data transfer out of the reversible counter has been completed, a signal emitted by the CPU is applied to the reversible counter, resetting the contents thereof to zero. The above process is successively repeated, so long as rotation of the crown is continued.

Thus, even if the clock frequency of the CPU is so low that it would be impossible for the highest frequency of correction pulses to be processed thereby, if the correction pulses were input directly in serial form to the CPU, the method of the present invention, by utilizing a reversible counter as a type of buffer memory/counter circuit enables the correction signal data to be reliably processed by the CPU. The maximum rate at which correction pulses can be generated is, in effect, made virtually independent of the clock signal frequency at which the CPU is operated. The present invention thereby enables the advantages of data input through a crown-actuated switch to be combined with the advantages of design flexibility and economy provided by the use of a CPU to perform the main data-processing functions of a timepiece, without the necessity for operating the CPU at a higher clock signal frequency that can be conveniently provided by the standard frequency oscillator circuit of the timepiece.

DESCRIPTION OF THE PREFERRED EMBODIMENT

Figure 1:
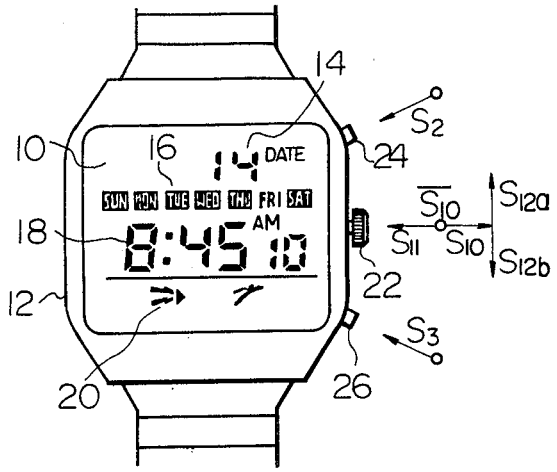
FIG. 1 is an external view of an example of an electronic timepiece according to the present invention.

FIG. 1 is an external view of an electronic timepiece having a correction data input system according to the present invention. Reference numeral 10 denotes an electro-optical display, and numeral 12 an external case. Display 10 includes a date display area 14, a weekdays display area 16, a time display area 18, and mode indication symbols 20. Numeral 22 denotes a crown, which is coupled to a set of switches, described hereinafter. One of these switches can be actuated by pushing crown 22 inward, in a direction indicated as $S_{11}$, from the normal rest position which is indicated as $\overline{S_{10}}$. Crown 22 can also be pulled outward, as indicated by $S_{10}$, and can then be rotated in the clockwise direction $S_{12a}$ thereby actuating a second switch or in the counterclockwise directions $S_{12b}$ thereby actuating a third switch. When crown 22 has been pulled out in direction $S_{10}$, then the contacts of a fourth switch are closed, while in the normal rest position ($\overline{S_{10}}$) the latter switch contacts are open.

Reference numeral 24 denotes a first pushbutton switch operating number, while numeral 26 denotes a second pushbutton switch operating member. These pushbutton switches are actuated by pushing inward, as indicated by $S_2$ and $S_3$.

Figure 2:
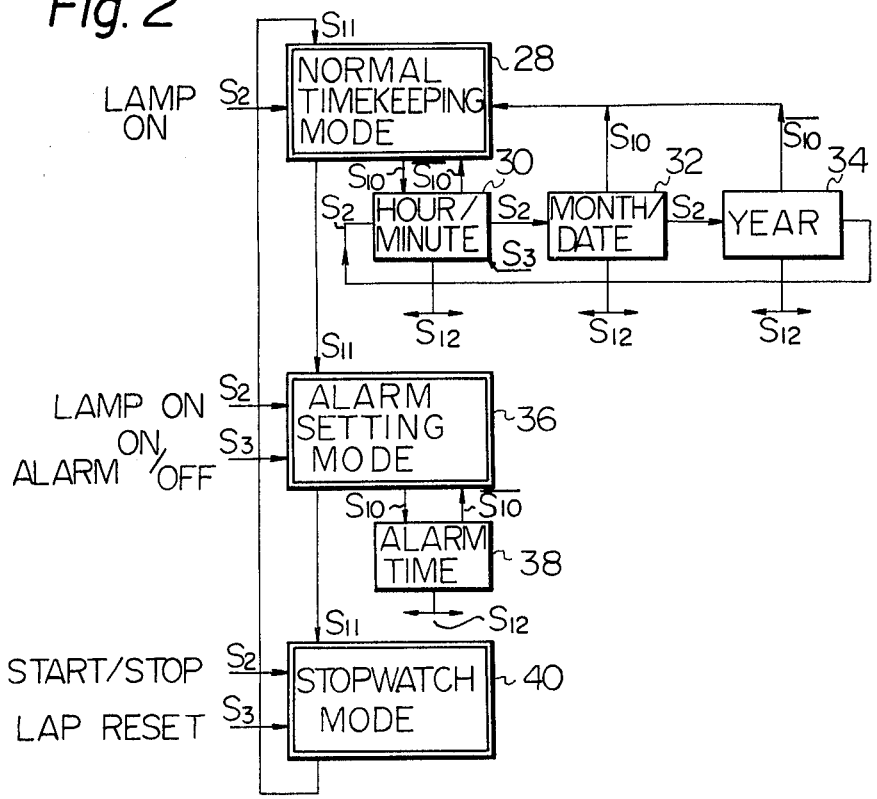
FIG. 2 is a diagram illustrating the relationships between various operating modes and corresponding actuations of operating switches in a timepiece having an input system according to the present invention.

FIG. 2 is a diagram illustrating the various operating modes of the timepiece of FIG. 1. Reference numeral 28 denotes the normal timekeeping mode. In this mode, actuation of crown 22 by pulling in the outward direction ($S_{10}$) causes the hours/minutes correction mode 30 for current time to be entered. In this mode, rotation of crown 22 in either the clockwise or the counterclockwise direction causes the minutes information to be incremented or decremented, and as rotation of crown 22 is continued, the hours information is successively incremented or decremented. In this mode also, the seconds data can be reset to zero by actuating switch operating member 26 ($S_3$), within the range±30 seconds.

If now switch operating member 24 is actuated once ($S_2$), then the month/weekday correction mode is entered, as indicated by numeral 32. In this mode, rotation of crown 22 in the clockwise or counterclockwise direction after setting to position $S_{10}$ enables the date information to be corrected. If now switch operating member 24 is again actuated ($S_2$) then the years information (if provided) can be corrected by rotation of crown 22, in the mode indicated by numeral 34. A return from any of these correction modes, 30, 32 and 34 can be performed at any time, by actuation of crown 22 back into the normal position ($\overline{S_{10}}$). In the normal timekeeping mode (crown 22 is at the normal position), when the switch operating member 24 is actuated ($S_2$), a dial illumination lamp is turned on.

In the normal timekeeping mode, if crown 22 is depressed inward ($S_{11}$), then the alarm setting mode 36 is entered. In this mode, correction of alarm time 38 can be performed by pulling crown 22 outward ($S_{10}$) and rotating the crown 22 clockwise or counterclockwise to increment or decrement the minutes and hours of a present alarm time to a desired value. In the alarm setting mode, switch actuation $S_2$ causes the dial illumination lamp to be turned on, while the alarm function can be turned on and off by successive actuations of switch operating member 26 ($S_3$).

A further actuation of crown 22 inward ($S_{11}$) causes the stopwatch mode to be entered (numeral 40). In this mode, stopwatch start/stop functions are performed by actuations of switch operating member 24 ($S_2$), while the lap reset function is performed by actuations of operating member 26 ($S_3$). In this mode, a further actuation of crown 22 in the $S_{11}$ direction causes the normal timekeeping mode to be entered.

Figure 3:
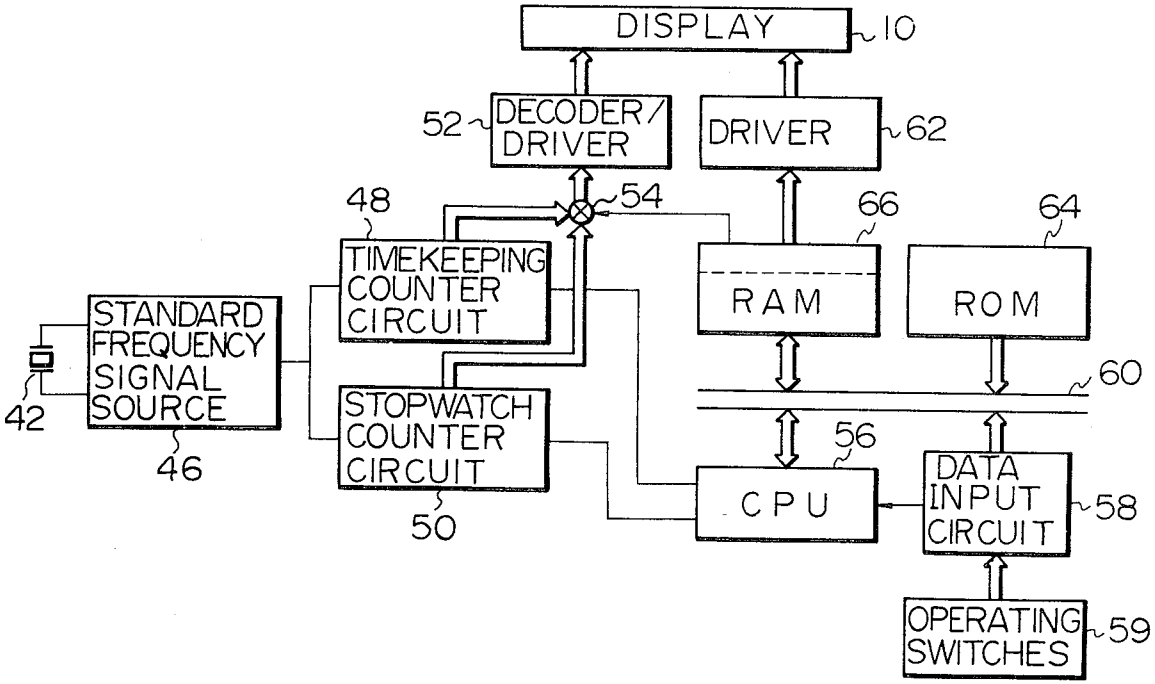
FIG. 3 is a simplified block diagram of an electronic timepiece embodiment according to the present invention.

Referring now to FIG. 3, a block diagram is shown therein of an embodiment of an electronic timepiece equipped with a CPU and having a data input circuit according to the present invention. Reference numeral 42 denotes a crystal vibrator, which controls the operating frequency of a standard frequency signal source 46. The standard frequency signal produced thereby is applied to inputs of a timekeeping counter circuit 48, which computes current time up to one minute (i.e. counter 48 is a seconds counter circuit) to thereby produce a carry output signal, i.e. a unit time signal having a period of one minute, and to a stopwatch counter circuit 50, which also counts up to one minute. Carry output signals from the timekeeping and stopwatch counters are input to a central processing unit (CPU) 56, which counts time data having a value greater than one minute units, as well as performing various other data processing functions to control the timepiece operation. Numeral 58 denotes a data input circuit, which receives various data input from a set of operating switches, actuated by crown 22 and operating members 24 and 26, described above. Data is output from and input to the CPU 56 over a data bus 60, which also receives data from input circuit 58. The operation of the CPU, and hence the overall functioning of the timepiece, are controlled by means of a control program which is stored in a read-only memory (ROM) 64. The control program can be changed as required, by applying a memory mask type of modification to the contents of ROM 64. The contents of timekeeping counter 48 and stopwatch counter circuit 50 are selectively transferred through a changeover circuit 54, to be applied to a decoder/driver circuit 52, in accordance with the particular operating mode of the timepiece. Output signals from decoder/-driver circuit 52 are applied to display 10, to provide a digital display of time information of less than a minute in value.

Time data counted by CPU 56, in response to the carry signals which are output from counter circuits 48 and 50, is applied over bus 60 to a random access memory circuit (RAM) 66. CPU 56 is operated by means of a clock signal derived from standard frequency signal source 46 (by means not shown in the drawings) only after a carry signal is output from timekeeping counter circuit 48 or stopwatch counter circuit 50, and until the computation necessitated thereby has been completed. Thereafter, CPU 56 is left in a non-operative state (i.e. with the supply of operating clock pulses cut off), until some further computation of other operation is necessary. In this way, the power requirements for operating CPU 56 are minimized, since, in the non-operative condition, the current consumed by CPU 56 amounts to only the leakage current of the CPU circuit.

While CPU 56 is in a non-operative state, it is necessary to display the data which has been computed thereby, on a continuous basis. This is achieved by providing an area in RAM 66 for storage of current time data which has been computed by CPU 56, and another area for storage of stopwatch data. Depending upon the particular operating mode, the data concerned is applied through a driver circuit 62, to be displayed by display 10. This data will comprise units and tens of minutes, units and tens of hours, date data, and so on.

In addition to being activated when a carry output signal is produced from timekeeping counter circuit 48 or from stopwatch counter circuit 50, ROM 64 is also activated when one of the operating switches 59 is actuated, in order to input time correction data, or to perform a mode changeover operation. The data which is input by means of the operating switches 59 is then input to the CPU, to be processed thereby.

Figure 4:
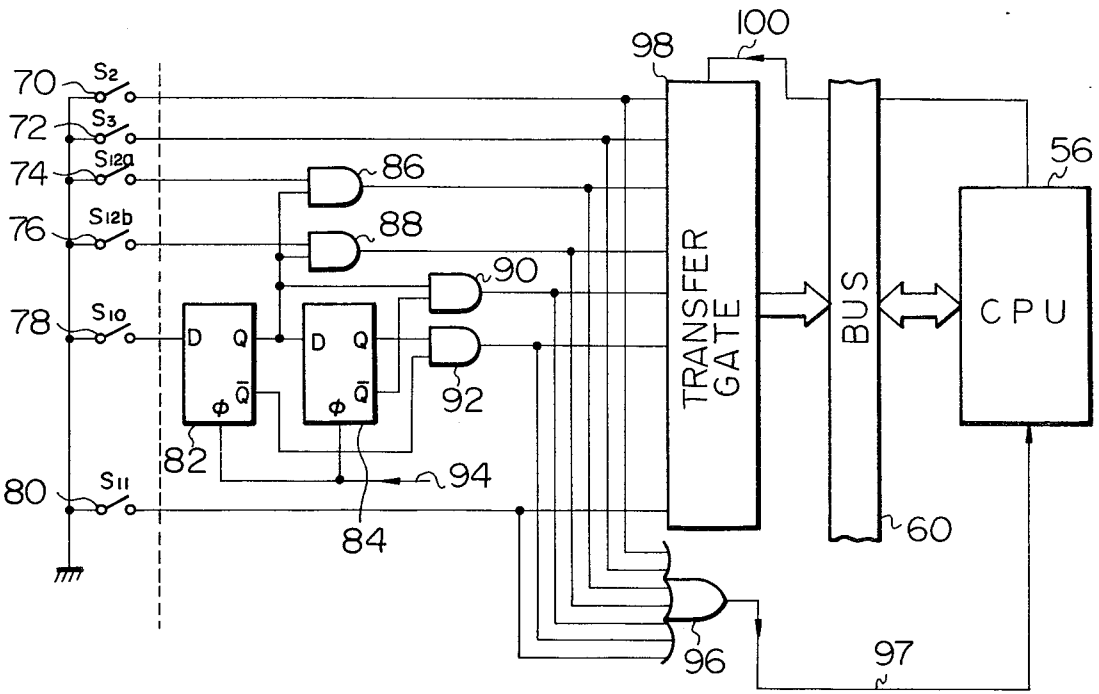
Fig. 4 PRIOR ART
FIG. 4 is a circuit diagram illustrating a conventional type of correction data input system for an electronic timepiece having a CPU.

Referring now to FIG. 4, an example of a prior art type of input circuit for an electronic timepiece having a CPU and a crown-operated switch mechanism is shown. Numeral 70 denotes a switch which is closed by actuation of operating member 24, shown in FIG. 1, in the direction $S_2$. Numeral 72 denotes a switch which is closed by actuation of operating member 26 in the direction $S_3$. Numeral 78 denotes a switch which is normally in the open position, when crown 22 is in the normal position ($\overline{S_{10}}$) and which is closed when crown 22 is pulled outward to the $S_{10}$ position. Numeral 80 denotes a switch which is normally in the open position, and which is closed when crown 22 is pushed in to the $S_{11}$ condition. Numeral 74 denotes a switch which is repetitively opened and closed when crown 22 is rotated clockwise after having been pulled outward. Numeral 76 denotes a switch which is repetitively opened and closed when crown 22 is rotated counterclockwise after having been pulled outward. Numerals 82 and 84 denoted data-type flip-flops, while numerals 86, 88, 90 and 92 denote AND gates, 96 an OR gate, 98 a transfer gate, and 100 a signal line over which a transfer gate control signal is applied to transfer gate, from CPU 56. A clock signal is applied over a signal line 94 to the clock terminals of flip-flops 82 and 84. The output of switch 78 is applied to the data terminal of flip-flop 82, while the output Q of flip-flop (hereinafter abbreviated to FF) 82 is applied to the data terminal of FF 84. The Q output of FF 82 and the $\overline{Q}$ output of FF 84 are applied to inputs of AND gate 90, while the $\overline{Q}$ output of FF 82 and the Q output of FF 84 are input to AND gate 92. Switch 74 is coupled to an input of AND gate 86, with the Q output of FF 82 being applied to the other input of this gate, while the switch 76 is coupled to an input of AND gate 88, with the Q output of FF 82 being applied to the other input of that gate. Signals produced by closure of switches 70, 72 and 80, as well as the outputs from gates 86,88, 90 and 92, are applied to inputs of OR gate 96. The output of OR gate 96 is connected, over a line 97, to a control input of CPU 56, and acts to initiate activation of CPU 56 in response to actuation of an operating switch.

The operation of the circuit of FIG. 4 is as follows. Assuming that crown 22 is pulled outward, switch 78 will be closed. In this example, the ground potential corresponds to the high logic level (referred to hereinafter as the H level), so that an H level potential is thereby applied to the data terminal of FF 82. The Q output of FF 82 thereby goes to the H logic level, in response to the clock signal supplied on line 94. One clock period after this occurs, the Q output of FF 84 will also go to the H logic level. Thus, when crown 22 is pulled out, the inputs to AND gate 90 are both at the H logic level during one period of the clock signal supplied to FF 82 and 84, i.e. a pulse of duration one clock period is output from AND gate 90 when crown 22 is pulled outward. In a similar way it can be seen that when switch 78 is subsequently closed, by returning crown 22 to its normal position (i.e. position $\overline{S_{10}}$), a pulse of one clock period duration will be output from AND gate 92.

After crown 22 has been pulled outward, so that the Q output of FF 82 is at the H logic level, it can be seen that H level pulses produced by successive actutations of switch 74, when crown 22 is rotated in the clockwise direction, will be transferred through AND gate 86 which will then be in the enabled condition. In other words, a train of pulses will be output from AND gate 86. Similarly, when the crown is rotated in the counter-clockwise direction after having been pulled outward, a train of pulses will be produced from AND gate 88. It can thus be seen that, each time either of the operating members 24 and 26 shown in FIG. 1 is actuated, or crown 22 is pulled outward (actuating switch 78) or pushed inward (actuating switch 80), or is rotated after having been pulled outward, one or more pulses will be output from OR gate 96. Any one of such pulses, applied over line 97 to CPU 56, serves to initiate activation of CPU operation, i.e. serves to notify the CPU that data input by means of the external operating members is to be processed by the CPU. When the CPU has been activated, with the commencement of supply of an operating clock signal to CPU 56, then a transfer gate enabling signal is output from CPU 56 over line 100, and applied to transfer gate 98. As a result of this enabling signal, transfer gate 98 thereafter transfers the data corresponding to the switch actuation into CPU 56, over data bus 60. Until such a switch actuation has been recognized by the CPU, i.e. until the CPU has been activated by an activation signal output by OR gate 96, CPU is held in a non-operative condition.

As stated hereinabove, however, the period between successive pulses of the train of correction pulses which are output from AND gate 86 or 88 in response to rotation of crown 22 can be of extremely short duration. Thus, since the operating clock signal of CPU 56 must generally be less than that of the standard frequency signal source of the timepiece, the operating speed of CPU 56 may be insufficient to enable processing of each correction pulse after such a pulse has produced an output from OR gate 96 to initiate activation of the CPU. In practice, this is a serious disadvantage of such a prior art type of input system for an electronic timepiece utilizing a crown-actuated switch mechanism for generation of a train of correction pulses, when these correction pulses have to be processed by a CPU.

Figure 5:
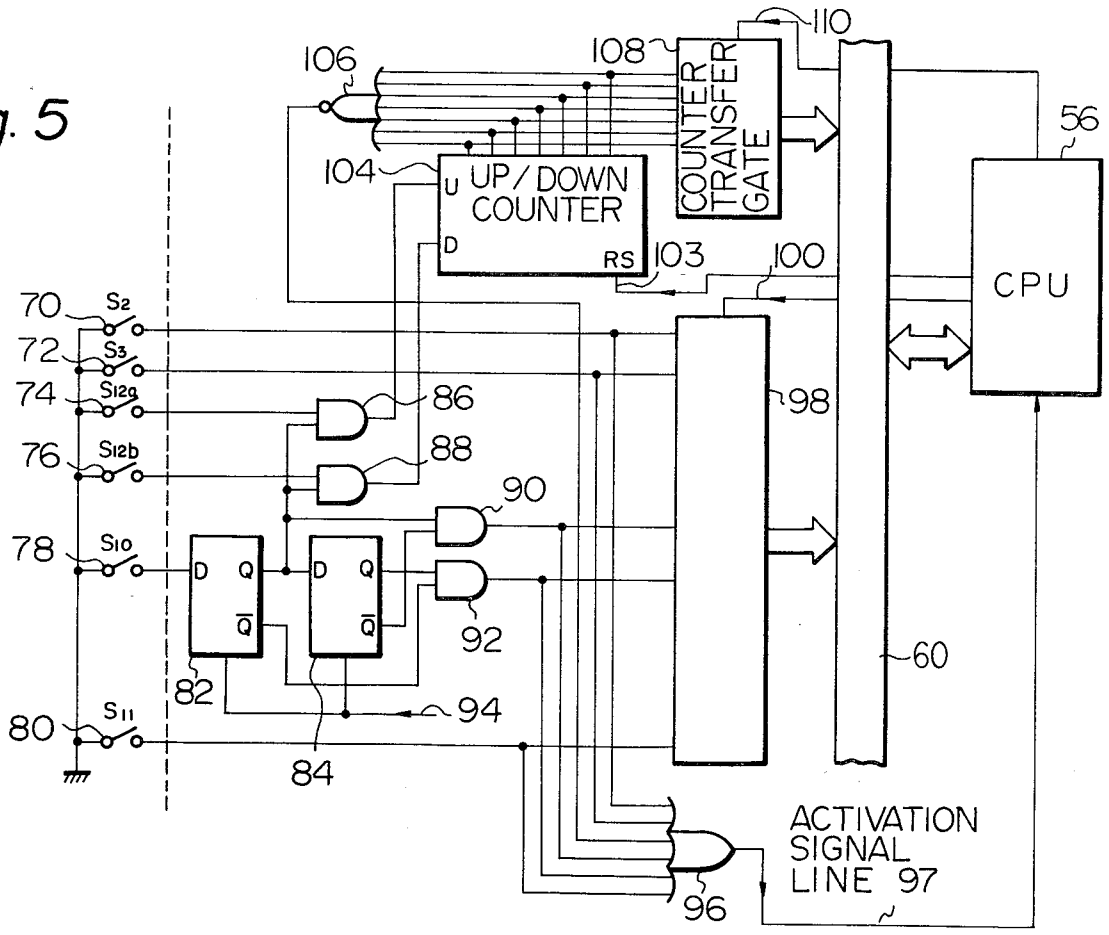
FIG. 5 is a circuit diagram illustrating an embodiment of a correction data input system for an electronic timepiece according to the present invention.

Referring now to FIG. 5, an embodiment of an input system for an electronic timepiece according to the present invention is shown. In FIG. 5, items denoted by numerals also shown in FIG. 4 above have identical functions to those described with respect to the prior art embodiment of FIG. 4, i.e. those items denoted by numerals 70 to 100, and 56 and 60. The principal features of novelty of the present invention, as exemplified in the embodiment of FIG. 5, is the incorporation of a reversible counter circuit 104, a zero-detection circuit comprising an OR gate 106, and a counter transfer gate circuit 108. In addition, in FIG. 5, the output of AND gate 86, is connected to an UP count input terminal of reversible counter 104, while the output of AND gate 88 is connected to the DOWN count input terminal of counter 104. Numeral 103 denotes a counter reset signal line, over which a reset signal is applied from CPU 56 to reset the contents of reversible counter 104 to zero, as described hereinbelow. The contents of reversible counter 104 are input in parallel form to transfer gate 108, and are transferred therethrough, over data bus 60 into CPU 56, when a transfer enable signal is emitted from CPU 56 and applied over signal line 110, as described below.

The operation of the circuit of FIG. 5 will now be described. The operation with respect to actuation of any of switches 70, 72, 78 and 80 is as described hereinabove, with respect to the system of FIG. 4, i.e. an output is produced from OR gate 96 to initiate activation of CPU 56 in response to actuation of any of these switches. Such operation will therefore not be described further in the following. It shall be assumed that the contents of reversible counter 104 are initially at zero, i.e. that counter 104 has been reset. In this condition, then if crown 22 is pulled outward and is rotated, a train of pulses will be produced from either AND gate 86 or AND gate 88, as described for the circuit of FIG. 4. Reversible counter 104 will thereby begin to count up or to count down, depending upon the direction of rotation of crown 22, i.e. depending upon whether the train of correction pulses is output from AND gate 86 or 88. The count in counter 104 will therefore cease to be zero. This fact will be detected by zero detection circuit 106, whose output will go from the low (L) logic level to the high (H) logic level. Since the output of zero detection circuit 106 is coupled to an input of OR gate 96, an activation signal will thereby be output from OR gate 96, and sent over signal line 97 to CPU 56. CPU 56 will thereby be subsequently activated, and when this occurs, a transfer signal will be sent over signal line 110 to counter transfer gate 108, causing the contents of reversible counter 104 at that instant to be transferred through transfer gate 108 and data bus 60 into CPU 56. Thus, even if an appreciable time (by comparison with the rate of generation of correction pulses out of AND gate 86 or 88) is required to begin activation of CPU 56 after rotation of crown 22 has commenced, this will have no effect upon the operation of the system, so long as the number of correction pulses generated during that time does not exceed the maximum count capacity of reversible counter 104. Immediately after the count of reversible counter 104 has been transferred to CPU 56 as described above, a reset signal is emitted by CPU 56, and applied over signal line 103 to a reset input of counter 104, thereby resetting the counter contents to zero. If the crown 22 continues to be rotated, the above process is then repeated, i.e. reversible counter 104 is successively reset to zero, and the contents thereafter transferred to CPU 56, in a repetitive manner.

When the user ceases to rotate crown 22, then the output of correction pulses from AND gate 86 or 88 will cease. Thus, when next the contents of reversible counter 104 are reset to zero, the counter will remain in the reset condition, so that the output of zero detection circuit 106 will remain at the L logic level. CPU 56 will thereafter remain in the inactivated condition.

From the above, it can be seen that, so long as the maximum count value of reversible counter 104 is selected suitably, the maximum rate of processing of correction pulses produced by rotation of crown 22 is in effect independent of the operating speed of CPU 56, i.e. independent of the operating clock frequency of CPU 56. This is due to the fact that activation of CPU 56 in response to rotation of crown 22 is made dependent upon the count status of reversible counter 104, rather than upon the detection of each individual correction pulse generated by rotation of crown 22, and also due to the fact that reversible counter 104 serves to count and temporarily store the count of correction pulses which are generated up to the point in time at which activation of CPU 56 is initiated, and permits this pulse count to be transferred in parallel form into CPU 56 to be processed thereby.

It will be apparent that various modifications may be made to the system illustrated in FIG. 5, which do not alter the basic features of the present invention. For example, various other arrangements are possible for the combination of crown-actuated switches and circuit elements whereby correction pulses are generated to be input to reversible counter 104. Similarly, counter transfer gate may be connected in some other position in the system, between the outputs of reversible counter 104 and the input terminals of CPU 56. Such changes do not alter the basic concepts of the present invention, whereby correction pulses generated by rotation of a crown are counted and temporarily stored in a counter circuit which normally contains a count of zero until such correction pulse generation occurs, and whereby detection of a non-zero count state of that counter circuit is utilized to initiate activation of a CPU which is normally held in a non-activated condition, with the contents of said counter being transferred into the CPU after activation of the CPU has commenced, and further whereby a signal from the CPU acts to reset the contents of that counter to zero after the contents of the counter have been transferred to the CPU to be processed as input data by the CPU, the process of transferring the counter contents to CPU and then resetting the counter contents to zero being successively and repetitively performed so long as generation of correction pulses by rotation of the crown is continued.

From the preceding description, it will be apparent that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative, and not in a limiting sense. The appended claims are intended to cover all of the generic and specific features of the invention described herein.

What is claimed is:

1. In an electronic timepiece having a crown and switch means coupled thereto and responsive to rotation of said crown for producing correction data comprising a train of correction pulses, a source of a unit time signal, a central processing unit coupled to receive said unit time signal with said central processing unit being normally in a state of non-activation and being periodically activated to perform time data processing in response to said unit time signal, and display means for displaying time data produced by said central processing unit, a correction signal input system for supplying said correction data from said crown-coupled switch means to said central processing unit, comprising:

counter circuit means coupled to receive said correction pulses, to count and temporarily store said correction data;

zero detection circuit means coupled to said counter circuit means for detecting a condition wherein the contents of said counter circuit means are other than zero, and for producing an output indicative of the occurrence of said condition; and transfer gate circuit means coupled between output terminals of said counter circuit means and said central processing unit;

said central processing unit being responsive to said output signal from said zero detection circuit means for being set into a state of activation and for generating a transfer enable signal when said state of activation has been attained, said transfer gate circuit means being responsive to said transfer enable signal for transferring the contents of said counter circuit means to said central processing unit to be processed thereby, said central processing unit further generating a counter reset signal after said transfer of said counter contents has been performed, said counter circuit means being responsive to said counter reset signal for being reset to a count of zero.

2. An electronic timepiece according to claim 1, wherein said switch means is responsive to rotation of said crown in one direction for producing a first train of correction pulses and is responsive to rotation of said crown in the opposite direction for producing a second train of correction pulses, and further wherein said counter circuit means comprises a reversible counter circuit responsive to said first train of correction pulses for counting upward and responsive to said second train of correction pulses for counting downward.

* * * * *